US008511459B2

(12) United States Patent
Akagi et al.

(10) Patent No.: US 8,511,459 B2
(45) Date of Patent: Aug. 20, 2013

(54) CIGARETTE BUNDLE FEEDER

(75) Inventors: Koichi Akagi, Tokyo (JP); Shigenobu Kushihashi, Tokyo (JP); Tetsuo Ueno, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 13/613,271

(22) Filed: Sep. 13, 2012

(65) Prior Publication Data

US 2013/0001045 A1 Jan. 3, 2013

Related U.S. Application Data

(63) Continuation of application No. PCT/JP2010/055097, filed on Mar. 24, 2010.

(51) Int. Cl.
*B65G 47/30* (2006.01)

(52) U.S. Cl.
USPC ..... 198/418.3; 198/494

(58) Field of Classification Search
USPC ..... 198/418.3, 418.2, 347.1, 493, 494, 198/495; 131/96, 110, 282
See application file for complete search history.

(56) References Cited

U.S. PATENT DOCUMENTS

| | | | | |
|---|---|---|---|---|
| 4,055,192 | A * | 10/1977 | Berlin et al. | 131/84.3 |
| 4,167,091 | A * | 9/1979 | Ruppert et al. | 198/418.1 |
| 4,503,967 | A * | 3/1985 | Erdmann et al. | 198/418.3 |
| 5,282,527 | A | 2/1994 | Etani et al. | |
| 5,548,941 | A | 8/1996 | Portaro et al. | |
| 6,298,976 | B1 * | 10/2001 | David | 198/418.3 |
| 7,185,658 | B1 | 3/2007 | Focke et al. | |
| 2009/0038630 | A1 | 2/2009 | Bertuzzi et al. | |

FOREIGN PATENT DOCUMENTS

| | | | |
|---|---|---|---|
| JP | 5-178312 | A | 7/1993 |
| JP | 7-137708 | A | 5/1995 |
| JP | 2001-31007 | A | 2/2001 |
| JP | 2009-40504 | A | 2/2009 |

* cited by examiner

*Primary Examiner* — James R Bidwell
(74) *Attorney, Agent, or Firm* — Birch, Stewart, Kolasch & Birch, LLP

(57) ABSTRACT

A cigarette bundle feeder has a discharge duct which forms a lower part of a hopper and delivers filter cigarettes towards a bottom plate located under the hopper to produce a cigarette bundle, the discharge duct having a plurality of discharge passages arranged adjacent to each other in a width direction of the hopper to make the filter cigarettes flow downwards separately, the discharge passages opening in one direction; a front plate disposed at one side of and adjacent to the discharge duct, and extending in the width direction to cover the discharged passages of the discharge duct; and a plurality of suction holes formed in the front plate and having open ends that open towards the discharge duct, for sucking, through the open ends, tobacco shreds that spill from the cigarette ends of the filter cigarettes and drop into a gap between the front plate and the discharge duct.

6 Claims, 5 Drawing Sheets

CIGARETTE BUNDLE FEEDER

CROSS REFERENCE TO RELATED APPLICATION

This application is a continuation of PCT/JP2010/055097 filed on Mar. 24, 2010, which is hereby expressly incorporated by reference into the present application.

TECHNICAL FIELD

The present invention relates to a feeder for forming a cigarette bundle and feeding the formed cigarette bundle to a transporting pocket.

BACKGROUND ART

In general, a commercially available cigarette pack contains an inner pack. The inner pack is fabricated by wrapping a bundle of filter cigarettes arranged in three staggered rows, or a so-called cigarette bundle, in an inner wrapper.

For that reason, equipment for manufacturing cigarette packs comprises an inner-pack wrapping machine. The wrapping machine receives a cigarette bundle and an inner wrapper at their respective feeding positions, and wraps the cigarette bundle in the inner wrapper.

The wrapping machine is therefore provided with a feeder for feeding the cigarette bundle towards the feeding position. The feeder includes a hopper storing a large number of cigarettes, discharge ducts arranged below the hopper and forming hopper outlets, and duct-side pushers placed near the lower ends of their respective discharge ducts (Patent Document 1).

More specifically, the inside of each of the discharge ducts is divided by partition walls into a plurality of discharge passages extending downwards. Each of the discharge passages delivers filter cigarettes contained in the hopper so that the cigarettes are aligned in a horizontal posture. The filter cigarettes are stacked in staggered rows on a bottom plate located under the discharge ducts, thereby being formed into a cigarette bundle.

The cigarette bundle is pushed out by the duct-side pusher from the side of the filter end face of the cigarette bundle, and thus transferred from the bottom plate towards a transporting bucket located on a conveyor. There is another well-known feeder of this type, in which an elevating transfer and a transfer-side pusher are interposed between the conveyor and the bottom plate.

In this case, the transfer receives a cigarette bundle pushed out of the bottom plate and then descends with the cigarette bundle. In a descent position, the cigarette bundle is further pushed out by the transfer-side pusher from the side of the filter end face of the bundle. The cigarette bundle is thus received by the transporting bucket located on the conveyor, and is transported with the bucket towards the feeding position of the wrapping machine.

PRIOR ART DOCUMENT

Patent Document

Patent Document 1: Unexamined Japanese Patent Publication (Kokai) No. 2009-40504

SUMMARY OF THE INVENTION

Problem to be Solved by the Invention

The above-mentioned discharge passages of the discharge duct open on a cigarette-end side of the filter cigarette. When the filter cigarette descends through the discharge passage, tobacco shreds may spill from the tip end of the filter cigarette, drop along the discharge passage inside and outside the discharge passage, and accumulate on the circumferential surfaces of previously descended filter cigarettes and on the bottom plate. Accordingly, the cigarette bundle is wrapped in the inner wrapper and formed into an inner pack with tobacco shreds adhered to the circumferential surfaces of the filter cigarettes. In the feeder provided with the transfer, when the cigarette bundle is pushed out towards the transfer by the duct-side pusher, the tobacco shreds accumulated on the bottom plate move with the cigarette bundle and drop into a gap between the bottom plate and the transfer.

The drop of tobacco shreds causes the tobacco shreds to be caught between the filter end face of the cigarette bundle and the transfer-side pusher, and makes the tobacco shreds to be firmly adhered onto the filter end face.

If the cigarette bundle in such a condition is wrapped in the inner wrapper to be formed into an inner pack, and if this inner pack is put into a cigarette package, the user notices the tobacco shreds adhered to the circumferential surface and filter end face of the filter cigarette when retrieving the filter cigarette from the inner pack to have a smoke.

It is an object of the present invention to provide a cigarette bundle feeder which reliably prevents tobacco shreds from adhering onto a filter end face of a filter cigarette and enables the manufacture of high-quality inner packs.

Means for Solving the Problem

To accomplish the above object, a feeder of the present invention is installed in a wrapping machine for wrapping a cigarette bundle made up of a plurality of filter cigarettes in an inner wrapper, and feeds the cigarette bundle towards a feeding position of the wrapping machine. The feeder comprises a hopper storing a large number of filter cigarettes in a horizontal posture, the filter cigarettes having cigarette ends faced to one direction; a bottom plate disposed under the hopper; a discharge duct forming a lower part of the hopper and delivers the filter cigarettes from the hopper towards the bottom plate to produce a cigarette bundle on the bottom plate, the discharge duct including a plurality of discharge passage arranged adjacent to each other in a width direction of the hopper to make the filter cigarettes flow downwards separately, the discharge passages opening in one direction;

a front plate disposed at one side of and adjacent to the discharge duct, and extending in the width direction to cover the discharge passages of the discharge duct; and a plurality of suction holes formed in the front plate and having open ends that open towards the discharge duct, wherein the suction holes suck, through the open ends, tobacco shreds that spill from the cigarette ends of the filter cigarettes and drop into a gap between the front plate and the discharge duct towards the bottom plate.

The tobacco shreds floating in air and the tobacco shreds dropping towards the bottom plate are sucked along with air between the front plate and the discharge duct. This prevents or considerably reduces the accumulation of the tobacco shreds on circumferential surfaces of previously descended filter cigarettes and on the bottom plate.

The ejection duct may include a plurality of partition walls dividing the discharge duct into the discharge passages and having end faces opposite to the one direction, and the open ends of the suction holes may face the end faces of the partition walls. In this case, the air suction through the suction holes is not applied directly to the tobacco shreds in tip ends of the filter cigarettes, so that the tobacco shreds can be prevented from being undesirably sucked from the tip ends of the filter cigarettes, and the suction does not increase the flow resistance of the filter cigarettes flowing down through the discharge passages.

The cigarette bundle feeder may further have a variable device for varying a suction amount from the suction holes. In this case, the tobacco shreds can be sucked according to a flow amount of tobacco shreds.

The cigarette bundle feeder further includes a conveyor having a transporting bucket that is capable of receiving a cigarette bundle and transports the cigarette bundle towards the feeding position with the transporting bucket, and a transfer mechanism that includes a transfer path connecting the bottom plate to the conveyor and transfers the cigarette bundle on the bottom plate towards the conveyor. The transfer mechanism may further include an elevating transfer that forms a part of the transfer path, receives the cigarette bundle from the bottom plate at an ascent position, and then descends to a descent position; a pusher that moves from a rest position to the conveyor side via the transfer when the transfer is in the descent position and thus pushes the cigarette bundle on the transfer from a direction of the filter-end-face side of the filter cigarettes to push the cigarette bundle into the transporting bucket of the conveyor; and an air injection nozzle that injects air to a gap between the transfer in the descent position and the pusher in the rest position.

The air injection nozzle injects air towards the gap between the transfer in the descent position and the transfer-side pusher, to thereby prevent tobacco shreds from adhering to the filter end face of the cigarette bundle located on the transfer and a front face of the transfer-side pusher. The cigarette bundle feeder can therefore securely feed the cigarette bundle with no tobacco shreds adhered to the filter end face towards the feeding position of the wrapping machine.

The transfer mechanism may further include an air suction duct that is disposed away from the air injection nozzle in an air injecting direction and sucks air. In this case, the air suction duct sucks the tobacco shreds blown away due to air injection from the air injection nozzle, to thereby prevent scatter of the tobacco shreds.

The pusher may be provided with a plurality of grooves in a pressing face that pushes the cigarette bundle. In this case, contact area of the transfer-side pusher with respect to the cigarette bundle is reduced. Consequently, the tobacco shreds are more effectively prevented from being caught between the filter end face of the cigarette bundle and the transfer-side pusher.

Preferably, the open ends of the suction holes have a substantially oval shape that is vertically long.

Technical Advantage of the Invention

The cigarette bundle feeder of the invention reliably prevents tobacco shreds from adhering to filter end faces of filter cigarettes and is capable of manufacturing high-quality inner packs.

BEST MODE FOR CARRYING OUT THE INVENTION

A cigarette bundle feeder of one embodiment of the present invention will be described below with reference to the attached drawings.

Figure 1:
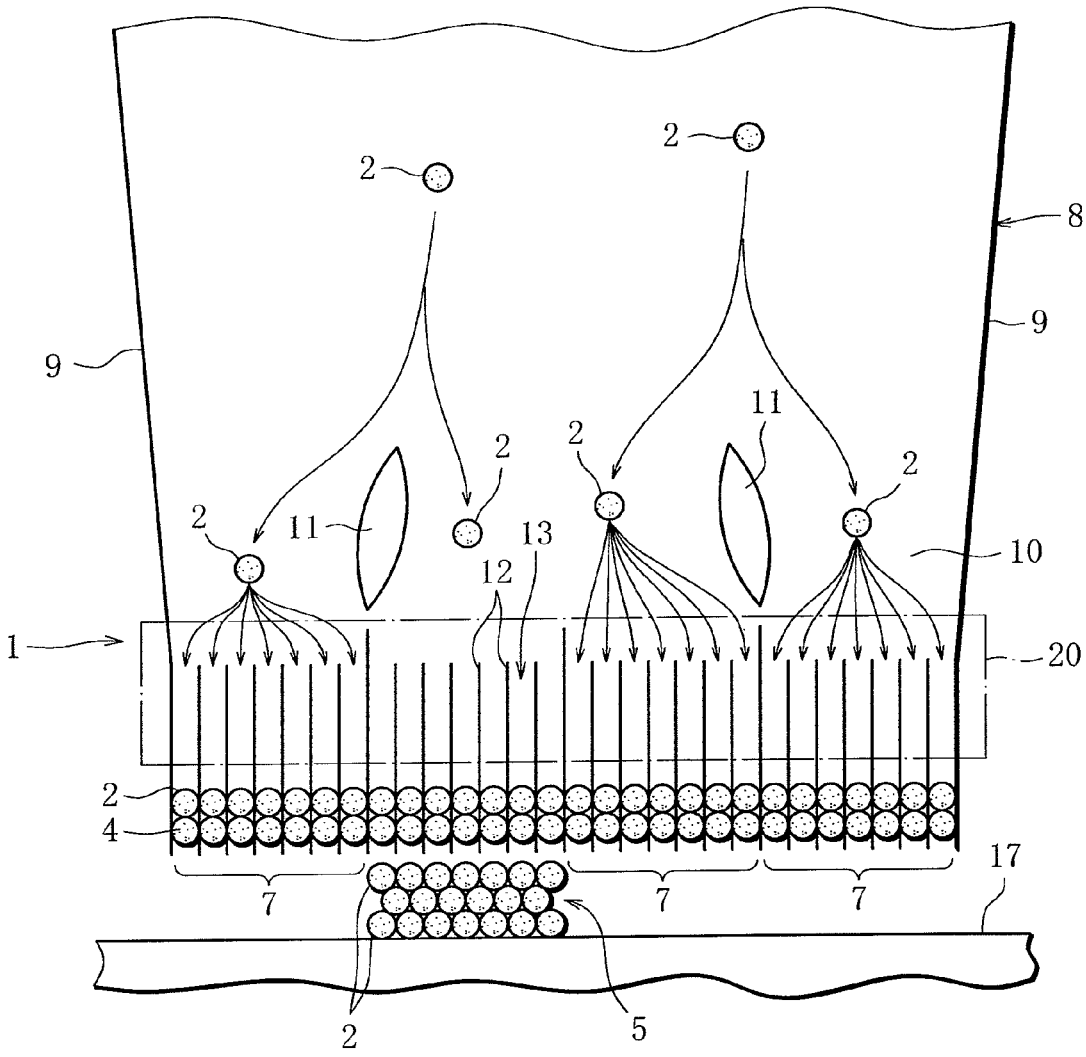
FIG. 1 is a schematic elevation view of a cigarette bundle feeder according to the present invention.

A feeder 1 shown in FIG. 1 comprises a substantially rectangular hopper 8. Filter cigarettes 2 are fed into the hopper 8 from an open end formed on the upper side of the hopper 8. The filter cigarettes 2 in large number are stored in a horizontal posture in the hopper 8 with their axes horizontally maintained and with filter ends facing the back of the hopper 8.

More specifically, the hopper 8 extends in a vertical direction and includes a rear panel 10 defining the depth of the hopper 8 and a pair of side panels 9 provided to right and left sides of the rear panel 10. In a center portion of an inner face of the rear panel 10, two spindle-shaped flow guides 11 are provided and horizontally spaced from each other. The flow guides 11 divide the downward flow of the filter cigarettes 2 in the hopper 8 into right and left streams, to thereby produce the uniform flow of the filter cigarettes 2 towards an outlet of the hopper 8.

A lower part of the hopper 8, that is, the hopper outlet, is formed of a plurality of discharge ducts 7. The discharge ducts 7 are arranged adjacent to each other in a width direction of the hopper 8. Each of the discharge ducts 7 is divided in inside thereof by a plurality of partition walls 12 arranged in the width direction of the hopper 8. The partition walls 12 downwardly extend from the hopper 8. Each of two adjacent partition walls 12 defines a discharge passage 13 in cooperation with each other. The discharge passage 13 guide the filter cigarettes 2 stored in the hopper 8 in line while maintaining the filter cigarettes 2 in the horizontal posture, and guide the cigarette line in the downward direction. The number of the discharge ducts 7 provided is four. Each of the discharge ducts 7 has seven discharge passages 13.

The discharge ducts 7, or lower ends of the discharge passages 13, open towards a bottom plate 17. A predetermined space required for the formation of cigarette bundles is vertically secured between the bottom plate 17 and the discharge ducts 7.

The cigarette lines flowing down through the discharge passages 13 of the discharge ducts 7 can therefore be delivered from the lower ends of the discharge passages 13 onto the bottom plate 17 via discharge control shutters (not shown).

As is well known, the filter cigarettes 2 are sequentially delivered from the discharge passages 13 of the discharge ducts 7 towards the bottom plate 17 due to the action of the discharge control shutters, whereby cigarette bundles 5 are formed on the bottom plate 17 in staggered rows.

Each of the cigarette bundles 5 has a three-layer structure containing 20 filter cigarettes 2.

The cigarette bundle 5 formed on the bottom plate 17 is transferred through an elevating transfer 15 to a transporting bucket located on a conveyor, thereby being received by the transporting bucket. A transfer mechanism 30 of the cigarette bundles 5 will be described below.

Figure 2:
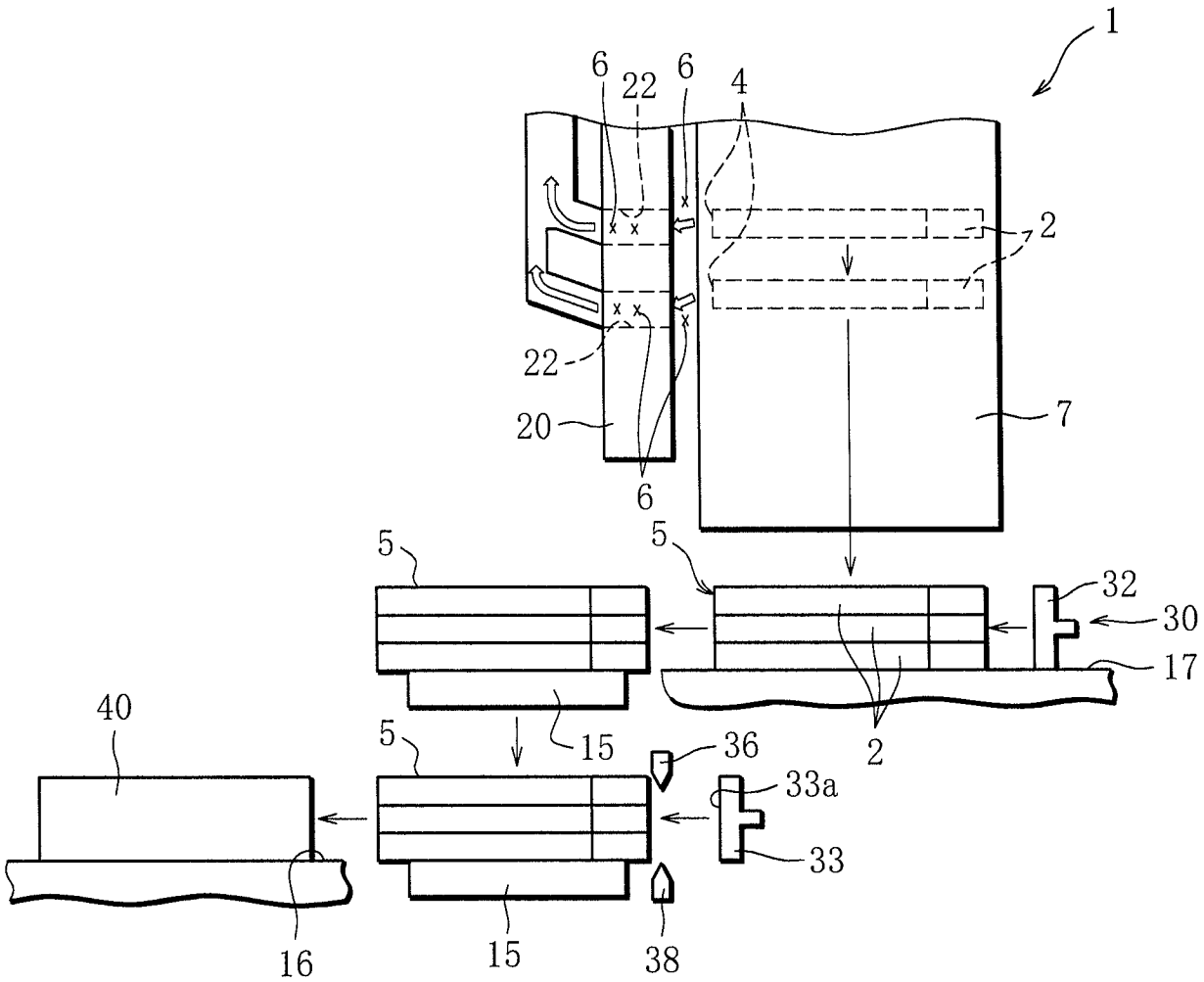
FIG. 2 is a side view of the feeder.

As shown in FIG. 2, the transfer mechanism 30 includes a duct-side pusher 32 provided to each of the discharge ducts 7. The duct-side pusher 32 is capable of reciprocating between a rest position located on the rear panel 10 side of the hopper 8 and the transfer 15. The transfer 15 is located in front of the hopper 8. The bottom plate 17 extends in front of the hopper 8. The transfer 15 is located close to a front edge of the bottom plate 17.

The duct-side pusher 32 pushes out the cigarette bundle 5 on the bottom plate 17 towards the transfer 15. The cigarette bundle 5 that has been pushed out is received by the transfer 15 located in the ascent position. The transfer 15 then descends with the cigarette bundle 5.

Disposed under the bottom plate 17 is a transfer-side pusher 33. The transfer-side pusher 33 is capable of reciprocating between a rest position under the bottom plate 17 and a transporting bucket 40 of the conveyor 16.

For that reason, when the transfer 15 is located in the descent position, this enables the transfer-side pusher 33 to push out the cigarette bundle 5 on the transfer 15 towards the conveyor 16 side. The cigarette bundle 5 that has been pushed out is received by the transporting bucket 40 of the conveyor 16. The cigarette bundle 5 is transported with the transporting bucket 40 towards the feeding position of the wrapping machine.

Since the discharge passages 13 of the discharge ducts 7 opens in a front face thereof, when the filter cigarette 2 flows down through the discharge path 13, tobacco shreds that have split from a tip end 4 of the filter cigarette 2 drop towards the bottom plate 17 and are accumulated on the circumferential surfaces of the filter cigarettes 2 that have previously descended and on the bottom plate 17.

In order to prevent the accumulation of tobacco shreds, the feeder of one embodiment comprises a front plate 20 in front of the hopper 8. The front plate 20 horizontally extends in the width direction of the hopper 8 and covers at least upper parts of the discharge ducts 7.

The front plate 20 has a large number of suction holes 22. The suction holes 22 each have an open end which opens towards the discharge ducts 7.

More specifically, the suction holes 22 are arranged to face front end faces of the partition walls 12 located in the discharge ducts 7, and form suction-hole lines spaced away from each other in a width direction of the suction plate 20 and arranged to extend in a horizontal direction. In the case of this embodiment, as is evident from FIG. 2, the suction holes are arranged at predetermined intervals in a vertical direction. Preferably, the open ends of the suction holes 22 each have a substantially oval shape which is vertically long.

Figure 4:
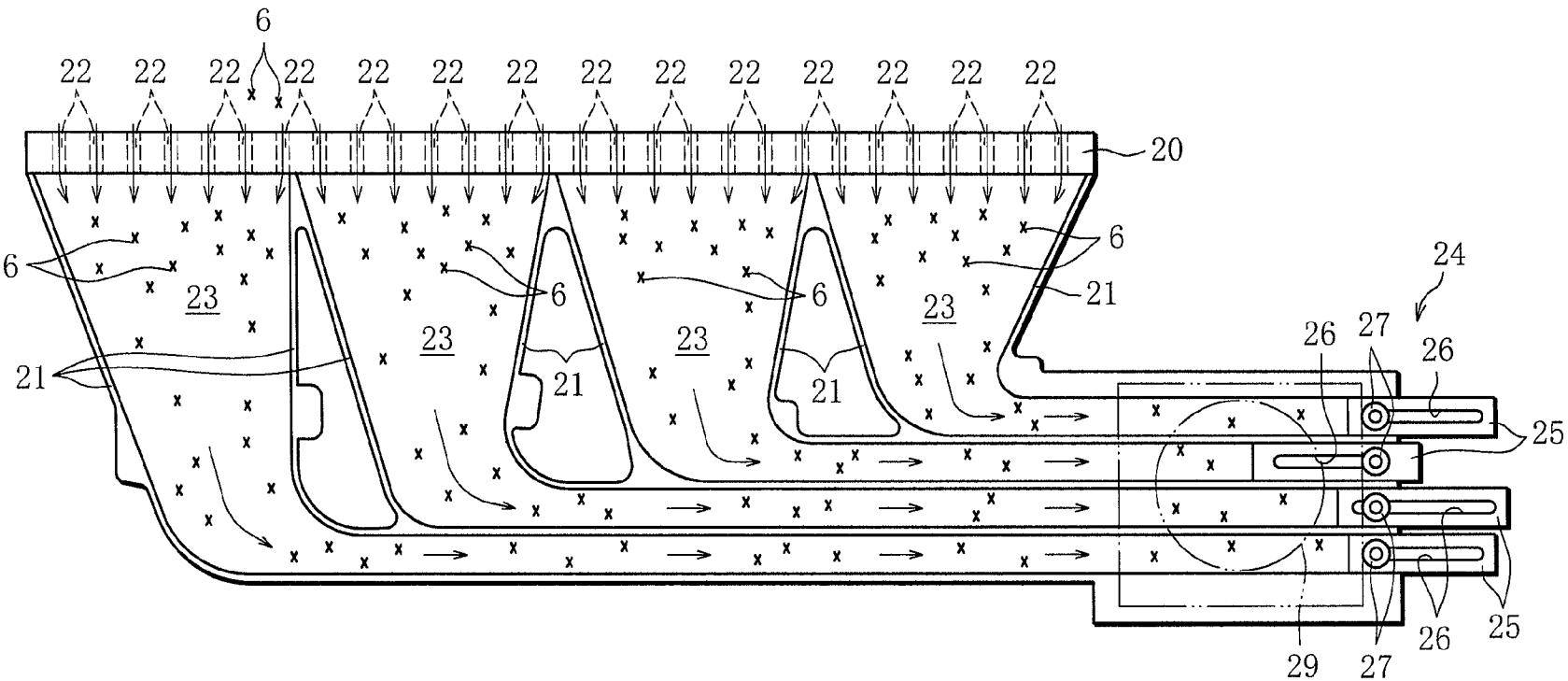
FIG. 4 is a plan view of the front plate.

The other ends of the suction holes 22 for each of the discharge ducts 7 are connected to one end of the same suction path 23 as shown in FIG. 4. The suction paths 23 are each defined by a pair of guide walls 21. The guide walls 21 extend towards the other end side of the suction paths 23 so that the width of the suction paths 23 is gradually reduced. The other ends of the suction paths 23 are connected to a suction source (not shown) via a suction duct 29 mentioned below. The suction paths 23 are provided with retrieval pouches (not shown). The suction paths 23 are covered with a cover (not shown), throughout the entire area thereof, except for a portion covered with the suction duct 29.

Figure 5:
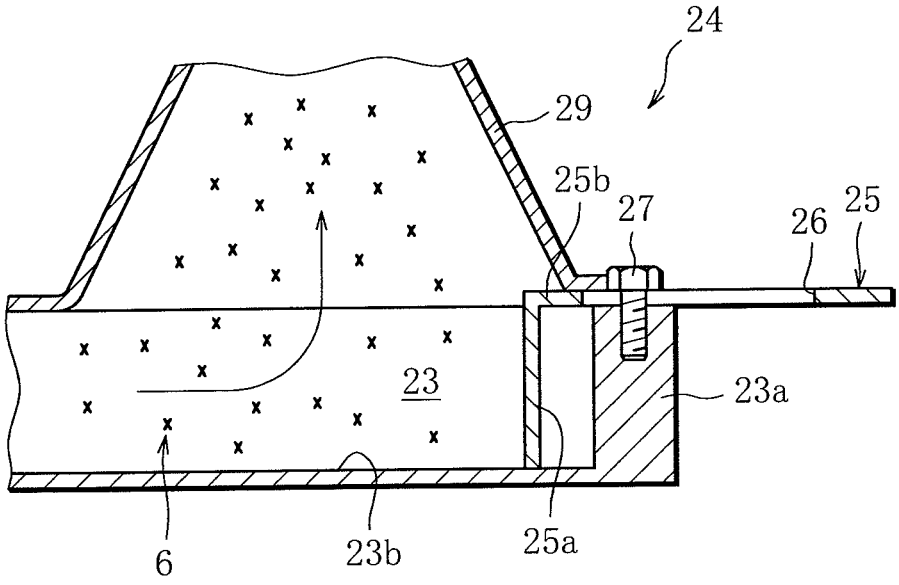
FIG. 5 is a sectional view of a suction path and a damper.

The suction paths 23 are provided with a variable device 24 capable of adjusting suction amount from the suction holes 22. The variable device 24 includes dampers 25, which are provided to the respective suction paths 23. As shown in FIG. 5, the dampers 25 each have horizontal wall **25*b* and a vertical wall 25*a*. The horizontal wall 25*b* extends along an opening edge of the corresponding suction path 23, whereas the vertical wall 25*a* extends from one end of the corresponding horizontal wall 25*b* towards a bottom face 23*b* of the suction path 23. A slide hole 26 is formed in the horizontal wall 25*b* of the damper 25. The slide hole 26 has an inner diameter so that a bolt 27 can be inserted through the slide hole 26, and is formed in a substantially oval shape extending in a longitudinal direction of the horizontal wall 25*b* of the damper 25. The bolt 27 is screwed into an upper face of the other-end wall 23*a* of the corresponding suction path 23. The dampers 25 are thus slidable in a path direction of the suction paths 23**.

The other end side of the suction paths 23, including the dampers 25, is covered with the suction duct 29 from above. The suction duct 29 has an open end in a substantially circular shape. For that reason, when the damper 25 is slid from a fully open position, at which the vertical wall **25*a* of the damper 25 and the other-end wall 23*a* of the suction path 23 are in contact with each other, towards the one end side of the suction path 23, the vertical wall 25*a* of the damper 25 reduces the area of the opening edge of the suction path 23 corresponding to the open end of the suction duct 29. This increases a suction speed of the suction path 23, and also increases a suction force for sucking tobacco shreds 6 from the suction hole 22**.

Figure 3:
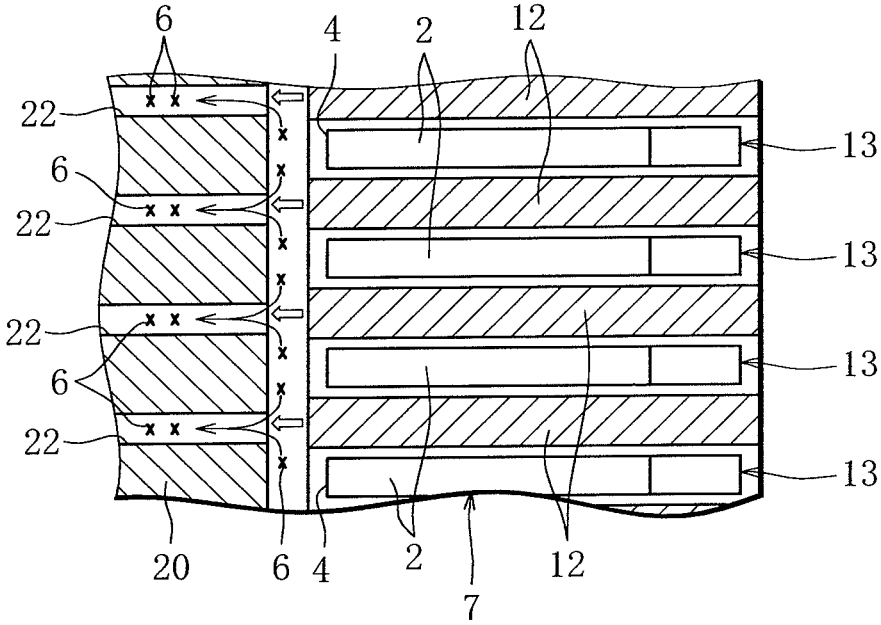
FIG. 3 is an enlarged sectional view of a discharge duct and a front plate as seen from above.

As shown in FIGS. 2 and 3, the suction holes 22 of the suction plate 20 suck the tobacco shreds 6 floating in air and the tobacco shreds 6 dropping towards the bottom plate 17 along with air within the discharge ducts 7 and between the front plate 20 and the discharge ducts 7. As a result, the tobacco shreds are prevented from being accumulated on the circumferential surfaces of the filter cigarettes 2 that have previously descended and on the bottom plate 17, and the accumulation is greatly reduced.

The suction holes 22 face the front end faces of the partition walls 12 in the discharge ducts 7, so that the air suction of the suction holes 22, which is shown by white arrows in FIGS. 2 and 3, is not directly applied to tobacco shreds in the tip ends of the filter cigarettes 2. The tobacco shreds are therefore prevented from being undesirably sucked from the tip ends of the filter cigarettes.

The air suction of the suction holes 22 does not increase the flow resistance of the filter cigarettes 2 flowing down through the discharge passages 13.

Furthermore, the dampers 25 of the suction paths 23 adjust the suction amount of the tobacco shreds 6 sucked from the suction holes 22, so that the tobacco shreds 6 are effectively sucked according to the condition of the downward flow thereof. In this case, since the dampers 25 are provided to the respective suction paths 23, it is possible to adjust the suction of the tobacco shreds 6 with respect to each of the discharge ducts 7, which forms a single cigarette bundle 5.

The tobacco shreds sucked by the suction holes 22 are retrieved into the retrieval pouches. The tobacco shreds 6 in the retrieval pouches are reused in cigarette manufacturing.

As is obvious from the foregoing explanation, the accumulation of tobacco shreds on the bottom plate 17 is prevented or greatly reduced, so that it is possible to eliminate almost all tobacco shreds that drop into the gap between the bottom plate 17 and the transfer 15 when the cigarette bundles 5 are transferred from the bottom plate 17 to the transfer 15.

When the cigarette bundle 5 is pushed out of the transfer 15 towards the transporting bucket 40 by the transfer-side pusher 33, there is no possibility that tobacco shreds are caught between the filter end face of the cigarette bundle 5 and the transfer-side pusher 33. The tobacco shreds are therefore effectively prevented from adhering to the filter end faces of the filter cigarettes 2. Consequently, the wrapping machine is capable of manufacturing high-quality inner packs.

The present embodiment is designed as below in order to further reduce the possibility that tobacco shreds adhere to the filter end face of the cigarette bundle 5.

Figure 6:
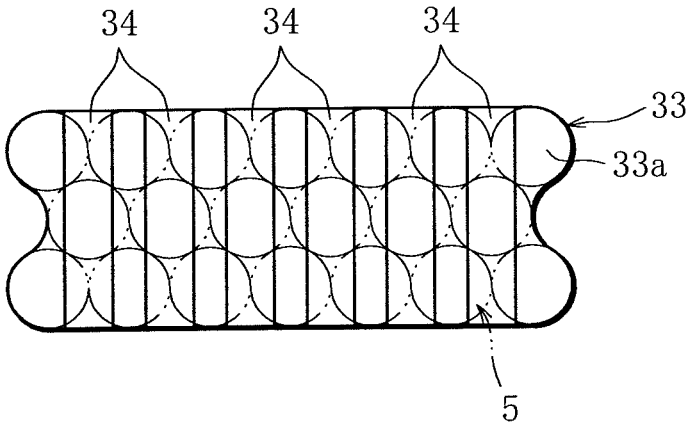
FIG. 6 is a view showing a situation where a base end face of a cigarette bundle and a pusher are in contact with each other.

The front face 33*a* of the transfer-side pusher 33 is of the size and of the shape substantially the same as those of a cross-section of the cigarette bundle 5. As shown in FIG. 6, a plurality of vertical grooves 34 is formed in the front face 33*a*. The vertical grooves 34 vertically extend throughout the entire height of the front face 33*a* and arranged at intervals in a width direction of the front face 33*a*. The vertical grooves 34 reduce the contact area of the front face 33*a* in contact with the cigarette bundle 5. However, as shown in FIG. 6, where each of the filter cigarettes 2 of the cigarette bundle 5 is represented by chain double-dashed lines, the front face 33*a* can contact the filter end faces of all the filter cigarettes 2.

An air injection nozzle 36 and an air suction duct 38 are disposed near the transfer-side pusher 33 in the rest position so as to be located above and underneath the transfer-side pusher 33, respectively. The air injection nozzle 36 is connected to a compressed air source (not shown), and the air suction duct 38 to a suction source (not shown). The air injection nozzle 36 injects air towards the gap between the transfer 15 in the descent position and the transfer-side pusher 33, to thereby prevent tobacco shreds from adhering to the filter end face of the cigarette bundle 5 on the transfer 15 and to the front face 33*a* of the transfer-side pusher 33. The feeder of the present embodiment therefore feeds the cigarette bundle 5 with no tobacco shreds adhered to the filter end faces towards the feeding position of the wrapping machine without fail.

The air suction duct 38 sucks the tobacco shreds blown away due to air injection from the air injection nozzle 36, to thereby prevent scatter of the tobacco shreds.

Moreover, if the vertical grooves 34 are formed in the front face 33*a* of the transfer-side pusher 33, and thus, the contact area of the transfer-side pusher 33 in contact with the cigarette bundle 5 is reduced as stated above, tobacco shreds are more effectively prevented from being caught between the filter end face of the cigarette bundle 5 and the transfer-side pusher 33.

The present invention is not limited to the above-described one embodiment, and may be modified in various ways.

For example, the suction holes 22 do not have to be formed in the oval shape, and the air injection nozzle 36 and the air suction duct 38 may be arranged away from each other in the horizontal direction.

When the air injection nozzle 36 injects air in the horizontal direction, it is preferable that horizontal grooves, instead of the vertical grooves 34, be formed in the front face 33*a* of the transfer-side pusher 33.

REFERENCE MARKS

1 feeder
2 cigarette
4 tip end
5 cigarette bundle
6 tobacco shreds
7 discharge duct
8 hopper
9 side panel
10 rear panel
11 flow guide
12 partition wall
13 discharge passage
15 transfer
16 conveyor
17 bottom plate
20 front plate
21 guide wall
22 suction hole
23 suction path
23*a* other-end wall
23*b* bottom face
24 variable device
25 damper
25*a* vertical wall
25*b* horizontal wall
26 slide hole
27 bolt
29 suction duct
30 transfer mechanism
32 duct-side pusher
33 transfer-side pusher
33*a* front face
34 vertical groove
36 air injection nozzle
38 air suction duct
40 transporting bucket

The invention claimed is:

1. A feeder installed in a wrapping machine for wrapping a cigarette bundle made up of a plurality of filter cigarettes in an inner wrapper, for feeding the cigarette bundle towards a feeding position of the wrapping machine, the feeder comprising:

a hopper storing a large number of filter cigarettes in a horizontal posture therein, the filter cigarettes having cigarette ends faced to one direction;

a bottom plate disposed under said hopper;

a discharge duct forming a lower part of the hopper and delivering the filter cigarettes from said hopper towards said bottom plate to produce a cigarette bundle on said bottom plate, said discharge duct including a plurality of discharge passages divided by a plurality of partition walls and arranged adjacent to each other in a width direction of said hopper to make the filter cigarettes flow downwards separately, the discharge passages opening in one direction;

a front plate disposed at one side of and adjacent to the discharge duct and extending in the width direction to cover the discharge passages of said discharge duct; and a plurality of suction holes formed in said front plate, said suction holes having open ends opened towards said discharge duct, wherein the partition walls have end faces opposite to the one direction, said front plate includes regions exclusively facing to the end faces of the partition walls, respectively, said suction holes are located in the regions of said front plate, and said suction holes suck, through the open ends thereof, tobacco shreds that spill from the cigarette ends of the filter cigarettes and drop into a gap between said front plate and said discharge duct towards said bottom plate.

2. The feeder according to claim 1, wherein the feeder further comprises a variable device for varying a suction amount from said suction holes.

3. The feeder according to claim 1, wherein the feeder further comprises a conveyor including a transporting bucket that is capable of receiving a cigarette bundle and transports the cigarette bundle towards the feeding position with the transporting bucket, and a transfer mechanism including a transfer path which connects said bottom plate to said conveyor and transfers the cigarette bundle on said bottom plate towards said conveyor, wherein said transfer mechanism further includes an elevating transfer forming a part of the transfer path, receiving the cigarette bundle from said bottom plate at an ascent position, and then descending to a descent position; a pusher that moves from a rest position to a conveyor side via said transfer when said transfer is in the descent position and thus pushes the cigarette bundle on said transfer from a direction of the filter-end-face side of the filter cigarettes to push the cigarette bundle into the transporting bucket of said conveyor; and an air injection nozzle for injecting air to a gap between said transfer in the descent position and the pusher in the rest position.

4. The feeder according to claim 3, wherein said transfer mechanism further includes an air suction duct disposed away from the air injection nozzle in an air injecting direction, for sucking air.

5. The feeder according to claim 3, wherein said pusher is provided with a plurality of grooves on a pressing face thereof for pushing the cigarette bundle.

6. The feeder according to claim 3, wherein the open ends of said suction holes have a substantially oval shape that is vertically long.

* * * * *